US008365492B2

(12) United States Patent
Frest et al.

(10) Patent No.: US 8,365,492 B2
(45) Date of Patent: Feb. 5, 2013

(54) BLAST PROTECTION WINDOW RETENTION SYSTEM

(75) Inventors: Brian Joseph Frest, Shady Side, MD (US); Ronald Michael Homen, Dunkirk, MD (US)

(73) Assignee: Glasslock, Inc., Easton, MD (US)

( * ) Notice: Subject to any disclaimer, the term of this patent is extended or adjusted under 35 U.S.C. 154(b) by 90 days.

(21) Appl. No.: 12/702,074

(22) Filed: Feb. 8, 2010

(65) Prior Publication Data

US 2011/0192328 A1 Aug. 11, 2011

(51) Int. Cl.
*E04B 5/12* (2006.01)

(52) U.S. Cl. ..... 52/473; 52/202; 52/1; 160/84.06; 160/172 R

(58) Field of Classification Search ..... 52/473.1, 52/508, 202, 222, 1; 89/36.04, 36.01, 36.14; 160/107, 34, 84.06, 172 R, 172 V
See application file for complete search history.

(56) References Cited

U.S. PATENT DOCUMENTS

| | | | | | |
|---|---|---|---|---|---|
| 2,819,499 | A | | 1/1958 | Abramson et al. | |
| 4,134,240 | A | * | 1/1979 | Bologna et al. | 52/202 |
| 4,184,297 | A | * | 1/1980 | Casamayor | 52/202 |
| 4,368,594 | A | * | 1/1983 | Milam et al. | 49/67 |
| 4,409,758 | A | * | 10/1983 | Dickerson et al. | 49/463 |
| 4,441,290 | A | * | 4/1984 | Abell | 52/202 |
| 4,453,585 | A | * | 6/1984 | Ruggeberg et al. | 160/354 |
| 4,557,309 | A | * | 12/1985 | Judkins | 160/84.06 |
| 4,561,223 | A | * | 12/1985 | Gold et al. | 52/202 |
| 4,599,825 | A | * | 7/1986 | Sixsmith | 49/466 |
| 4,630,411 | A | * | 12/1986 | Salzer | 52/1 |
| 4,739,816 | A | | 4/1988 | Dodich et al. | |
| 4,932,710 | A | | 6/1990 | Chen | |
| 5,460,215 | A | * | 10/1995 | Schon | 160/84.06 |
| RE35,926 | E | | 10/1998 | Hagen | |
| 5,907,929 | A | | 6/1999 | Poma et al. | |
| 5,915,449 | A | | 6/1999 | Schwartz | |
| 6,010,758 | A | | 1/2000 | Anglin, Jr. | |
| 6,044,889 | A | | 4/2000 | Liu | |
| 6,057,029 | A | | 5/2000 | Demestre et al. | |
| 6,212,840 | B1 | | 4/2001 | Davidovitz | |
| 6,216,401 | B1 | | 4/2001 | Emek | |
| 6,298,766 | B1 | * | 10/2001 | Mor | 89/36.04 |
| 6,319,571 | B1 | | 11/2001 | Anglin, Jr. | |

(Continued)

OTHER PUBLICATIONS

Window Film® Architectural, Auto, Decorative, Security, 7(1), Jan.-Feb. 2003, http://www.usglassmag.com/Film/BackIssues/Jan-Feb03/noteworthy.html, 2 pages.

(Continued)

*Primary Examiner* — Phi D. A
(74) *Attorney, Agent, or Firm* — Duane Morris LLP

(57) ABSTRACT

A blast resistant window system includes a plurality of anchor members disposed in a wall and first and second mounting bodies at first and second opposite ends of an opening in the wall secured with the anchor members. The first mounting body has a first pair of spaced brackets connected thereto, and the second mounting body having a second pair of spaced brackets connected thereto. First and second energy dampening devices are disposed between the first and second pairs of spaced brackets. First and second restraining cables extend between the first and second mounting bodies across the inside surface of the window pane. These cables have first and second ends connected to the first and second pairs of spaced brackets. The cables are coupled together at the first and second opposite ends of the opening by the first and second energy dampening devices.

21 Claims, 9 Drawing Sheets

U.S. PATENT DOCUMENTS

| | | | |
|---|---|---|---|
| 6,333,085 | B1 | 12/2001 | Emek |
| 6,338,377 | B1 | 1/2002 | Domel |
| 6,349,505 | B1 | 2/2002 | Figge et al. |
| 6,385,924 | B1 | 5/2002 | Emek |
| 6,494,000 | B1 | 12/2002 | Emek |
| 6,497,077 | B1 | 12/2002 | Emek |
| 6,502,356 | B2 | 1/2003 | Emek |
| 6,509,071 | B1 | 1/2003 | Emek |
| 6,530,184 | B1 | 3/2003 | Emek |
| 6,536,174 | B2 | 3/2003 | Foster et al. |
| 6,604,322 | B2 | 8/2003 | Horn et al. |
| 6,648,048 | B2 | 11/2003 | Lai |
| 6,718,705 | B2 | 4/2004 | Emek |
| 6,764,728 | B2 | 7/2004 | Emek |
| 6,796,360 | B2 | 9/2004 | Ferrie et al. |
| 6,907,710 | B2 | 6/2005 | Trundle |
| 7,036,279 | B2 | 5/2006 | Crozzoli |
| 2004/0025453 | A1 | 2/2004 | Coddens |
| 2006/0032160 | A1 | 2/2006 | Gazaway et al. |

OTHER PUBLICATIONS

Shustive, V., "Sails-Rigging Blast Protective Structural Shield", Structual Research Detail, California State University Northridge, College of Engineering & Computer Science, Dept. of Civil & Manufacturing Engineering, May 24, 2001, pp. 1-10.

"Security Blinds Ltd.," Product Development Projects, Sheffield Hallam University Engineering Services to Industry, www.shu.ac.uk/schools/eng/industry/productsblinds.html, accessed Nov. 11, 2005, pp. 1-2.

Smilowitz, R., "Retrofitting Existing Buildings to Resist Explosive Threats", WBDG Whole Building Design Guide, www.wbdg.org/design/retro_rstexplo.php, updated Apr. 1, 2005, National Institute of Building Sciences, pp. 1-9.

O'Daniel, J. L. et al., "Numerical and Experimental Evaluation of Blast Retrofit of Windows", 16th ASCE Engineering Mechanics Conference, University of Washington, Seattle, Jul. 16-18, 2003, pp. 1-12.

"Retrofits for Existing Windows to Protect Occupants from Injurious Debris Due to a Bombing", Karagozian & Case, presented at 71st Shock & Vibration Symposium, Nov. 2000, Arlington, VA., pp. 1-8.

McMurrow, E., "Life Safety: Curtain Wall, The Glass Shield", McMorrow report.com, Trends for Facilities, Real Estate & Outsource Management, © 2003-2005 McMorrow Rep;ort LLC, pp. 1-2.

Advanced Solutions, Advanced Protection, "Cable System", www.al-sorag.co.il/page15.html, accessed Nov. 10, 2005, pp. 1-3.

Sunshine, D.A. et al., "TSWG Blast Mitigation Program", (undated), pp. 1-13.

"Energy Absorbing Retrofit System for Mitigating Blast Effects on Occupants of Conventional Buildings", Karagozian & Case, submitted to 29th Explosives Safety Seminar, New Orleans,LA., Jul. 2000, pp. 1-10.

Fabric Catcher System® product information, GSA, www.mechoshade.com/site/gas/fabric_catcher.cfm, accessed Nov. 11, 2005, 1 page.

FEMA—Building Design for Homeland Security: Resident Course, Unit IX: Building Design Guidance, Visual IX-28 Blast Curtains and Visual IX-29 Catch Bar, (undated), 1 page.

Multi-Hazard Window (Glazing) Retrofit Design, document No. 6025, ER One, Facility Multi-Hazard Mitigation, May 5, 2002, pp. 1-8.

Matico FrameGard Test Report, Explosion Range Testing, ComBlast 2002, Aug. 20, 2002, pp. 1-15.

Airblast Protection Retrofit for Annealed Glass Windows, Dept. of the Army, U.S. Army Corps of Engineers, Technical Letter No. 1110-x-xxx, Oct. 26, 1998, pp. 1-16.

FM3-19.30 (formerly FM 19-30) Physical Security, Headquarter, Department of the Army, Washington, DC, Jan. 8, 2001, pp. 1-317.

Aluminum Security Mesh, Solomon Security and Blinds, © 2002, www.solomonsecurityandblinds.com.au/security_allow_mesh_pat, 1 page.

Barker, D. et al., Summary Report, Test Program for Evaluation of Filmed Windows Subjected to Blast Loads, WBE Project 817-001, prepare for CHB Industries, Inc., Jan. 1997, pp. 1-8.

Barker, D. et al., Summary Report, Test Program for Evaluation of Filmed Windows Subjected to Blast Loads Phase II, WBE Project No. 875-01, prepared for CHB Industries, Inc., Aug. 1997, pp. 1-13.

Ashbury, W.B., "U.S. Department of State Approach to Physical Security as Related to Blast Mitigation", (undated), pp. 1-8.

Letter to Joseph L. Smith, Applied Research Associates, Inc. from CHB Industries forwarding Testing Summary of Hardglass 10 Mil 3-Ply Security Window Film by Wilfred Baker Engineering, Inc., Oct. 27, 1997, pp. 1-11.

Excerpt from design specification for glazing blast mitigation project for shell Chemical Co., drawn up by EQE International, 1990's, pp. 1-7.

* cited by examiner

BLAST PROTECTION WINDOW RETENTION SYSTEM

FIELD OF THE INVENTION

The present invention relates to blast protection systems, and more particularly to blast protection systems for windows.

BACKGROUND OF THE INVENTION

Physical security for buildings, offices, residences, etc. is a growing concern. One such security concern is damage caused by explosions, such as a bomb detonation, that may occur exterior to a structure. Though a building's inherent structural integrity can often mitigate the impact of some types of explosions, the impact can be aggravated by the presence of windows in the building. Glass shards from breaking windows can cause substantial damage and injury to persons and property inside a building even if the structural damage to the building is minimal. It has been reported that glass shrapnel from shattering windows causes over eighty percent (80%) of the serious injuries from a bomb blast event.

Many useful devices have been developed to secure and protect structures from blast events. These devices can be divided into two broad categories: (i) replacement of the existing glass and framing window system with a blast resistant window system, and (ii) installation of a retrofit product or products onto or in front of the existing glass and framing system on the interior of the building, while keeping the original window unit in place.

Typically, the most effective method is to completely replace the existing window system with a blast resistant window system designed specifically for the building's structure and the estimated blast load; however, it can be cost prohibitive to treat an entire building in this manner. Another option is to install retrofit products such as fragment retention films that can be anchored to the existing window frame; however this approach has its own limitations and may not be a viable option for many reasons, such as, for example: (i) hardening the window with current retrofit treatments may actually cause greater structural damage to the building in a blast event; (ii) the window, glass, or frame construction may not allow hardening using current retrofit treatments; or (iii) the available retrofit treatments that are technically possible are not aesthetically acceptable.

The typical minimum protection technique for retrofitting windows is to apply a fragment retention film (FRF) or shatter-resistant window film (SRWF) (collectively, "blast protection film") to the visible portion of the glass in what is termed a "daylight configuration." Although the fragment retention film will hold the glass shards together during a blast event, the window pane may fly into the room as one piece, possibly causing blunt trauma injury.

The fragment retention film can be anchored to the existing window frame using various techniques. This application usually is sufficient for low level blasts if the existing window frame has sufficient structural integrity to accept the blast load generated by the film and anchoring system. In some window systems, however, it is not feasible to install an anchored fragment retention film. Therefore other retrofit fragment retention film configurations must be used in conjunction with products that catch the filmed glass after it leaves the window frame in a blast event.

In the mid 1990s, the US Army Corps of Engineers developed a retrofit "catchbar system" that consisted of a steel tube placed across a window and mounted securely into the structure's wall. The window glass was treated with a fragment retention film. During a blast, the bar literally caught the filmed glass as it exited the window frame. The US Army Corps of Engineers published its blast results and design in an Engineering Technical Letter for use by manufacturers, designers, and end users describing the design and implementation of this concept. This method worked well for lower blast pressures, but at higher blast pressures the film tore from impact with the rigid catch bar, allowing two pieces of filmed glass to fly into the room.

A solution to this problem was developed in the form of a deployable catchbar. The deployable catchbar system consists of a catchbar which contains and conceals a steel cable that is fastened on each end to the window frame or to the building's structure as appropriate. In a blast, the filmed glass is blown into the catchbar, which is mounted an inch or two from the glass window on the inside of the building. The catchbar engages the glass and exits the frame as well; however, the steel cable allows the catchbar to travel a short set distance but then stops the catchbar and glass sheet from traveling any further. The advantage of this system is that it allows the blast pressure to vent around the glass sheet and decelerates the glass sheet less abruptly. The assignee of the present application blast tested this product and presented its results to the Protective Glazing Council Symposium in 2000 at the General Services Administration (GSA) Headquarters Building in Washington, D.C. Many variations of this product have been developed and sold by different manufacturers. Some manufacturers even use a cable or strap system without the catchbar depending on the design blast load and aesthetics.

The catchbar concept, while effective, does has some drawbacks. Its effectiveness depends on the number of catchbars mounted across the window, and even the deployable version may cause the filmed glass to split where the catchbar engages the filmed glass in large blasts, at least with bare cable catchbars. Also, this approach is relatively ineffective when used in conjunction with insulating glass since only the interior pane is treated with fragment retention film.

U.S. Published Application No. 2006/0032160A1 to Gazaway et al. entitled "Retrofit Glass Fragment Catching System" describes a blast resistant window blind system, the entirety of which is hereby incorporated by reference herein.

An improved blast resistant window system is desired.

SUMMARY OF THE INVENTION

In one disclosed embodiment of the invention, a blast resistant window system is installed over a reinforced window pane supported by a window framework mounted in an opening in a wall of a structure, the window pane having an inside surface facing an inside of the structure and an outside surface facing an outside of the structure. The blast resistant window system includes a plurality of anchor members disposed in the wall of the structure and first and second mounting bodies disposed at first and second opposite ends of the opening and secured to the structure with the anchor members, the first mounting body having a first pair of spaced brackets connected thereto, the second mounting body having a second pair of spaced brackets connected thereto. A first energy dampening device is disposed between the first pair of spaced brackets and a second energy dampening device disposed between the second pair of spaced brackets. First and second restraining cables extend between the first and second mounting bodies across the inside surface of the window pane, the first and second restraining cables having first ends connected to the first pair of spaced brackets and second ends connected to the second pair of spaced brackets, wherein the cables are coupled together at the first opposite end of the opening by the first energy dampening device extending therebetween and at the second opposite end of the opening by the second energy dampening device extending therebetween.

The above and other features of the present invention will be better understood from the following detailed description of the preferred embodiments of the invention that is provided in connection with the accompanying drawings.

BRIEF DESCRIPTION OF THE DRAWINGS

The accompanying drawings illustrate preferred embodiments of the invention, as well as other information pertinent to the disclosure, in which.

DETAILED DESCRIPTION

Figure 1A:
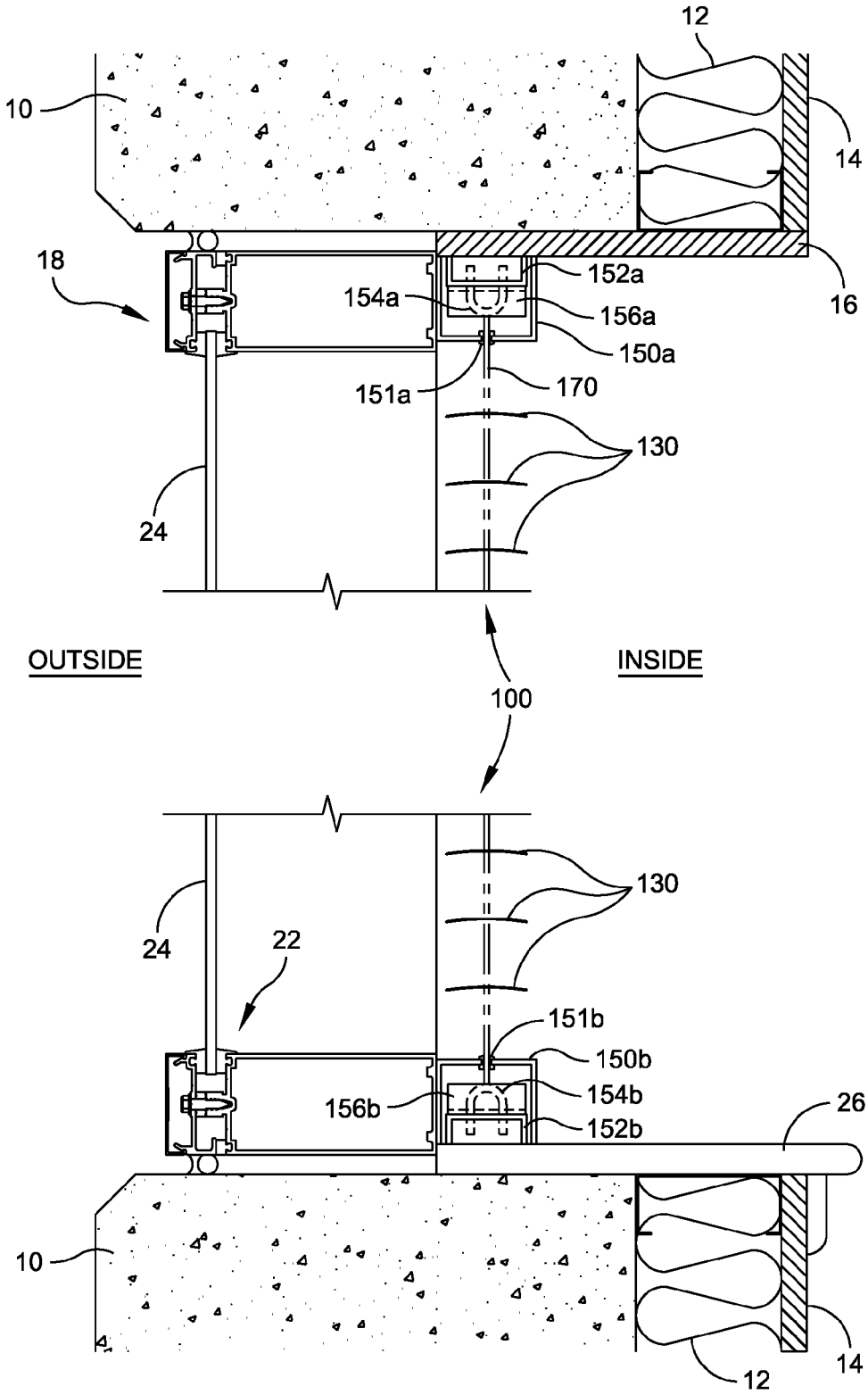
FIG. 1A is a side elevation view showing a blast retention system installed at the inside side of a standard window system.

This description of the exemplary embodiments is intended to be read in connection with the accompanying drawings, which are to be considered part of the entire written description. In the description, relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

Embodiments of a blast resistant window system are provided herein. In one embodiment, the blast resistant window system can be retrofitted over an existing window pane or panes in a structure, however the system can also be installed as part of an original construction. Preferably, the pane or panes of a window supported by a frame are treated in some manner to prevent (or reduce the likelihood of) the pane(s) from shattering into multiple projectiles during a blast event. For example, the pane(s) can be reinforced with a blast protection film or comprise laminated glass, the details of which are familiar to those in the art and are not repeated herein so as to avoid unnecessarily obscuring the details of the present invention. The blast resistant window system can be integrated with a blind system or be a stand-alone system as desired.

The retention system is assembled and installed over a window in an opening of a structure at the inside side of the window/structure, so that the window pane(s) is blown into the retention system by a blast occurring outside of the structure. Throughout this description, this opening is sometimes referred to as a "frame" having header, footer and jamb members. It should be understood that the frame can be defined by the structure wall itself or the structure wall in combination with other construction elements generally forming a support framework for the window pane or panes.

FIG. 1A partial side cross-sectional view of a structure 10 having a standard window system installed therein along with a blast retention system 100 installed thereover. The standard infrastructure includes a wall 10 of a structure having an opening formed therein for a window. The wall 10 and window separate the outside and inside regions, which are labeled as such in FIG. 1. Insulation 12, drywall 14, header 16 and sill 26 are shown. A reinforced window pane 24 is secured between window frame header and window frame footer components 18 and 22, respectively. The illustrated window and frame do not form a part of the invention and are presented for illustrative purposes only. Those of ordinary skill in this art will recognize that a structure 10 can have any number of different window configurations.

A blast retention system 100 is shown in FIG. 1A coupled to the wall 10 in the opening formed therein. The blast retention system 100 is located to protect the inside of the structure by catching the reinforced glass pane 24 if it is blown out of its frame towards the inside of the structure. Further details of the retention system 100 are shown in FIGS. 1B to 2D.

Figure 1B:
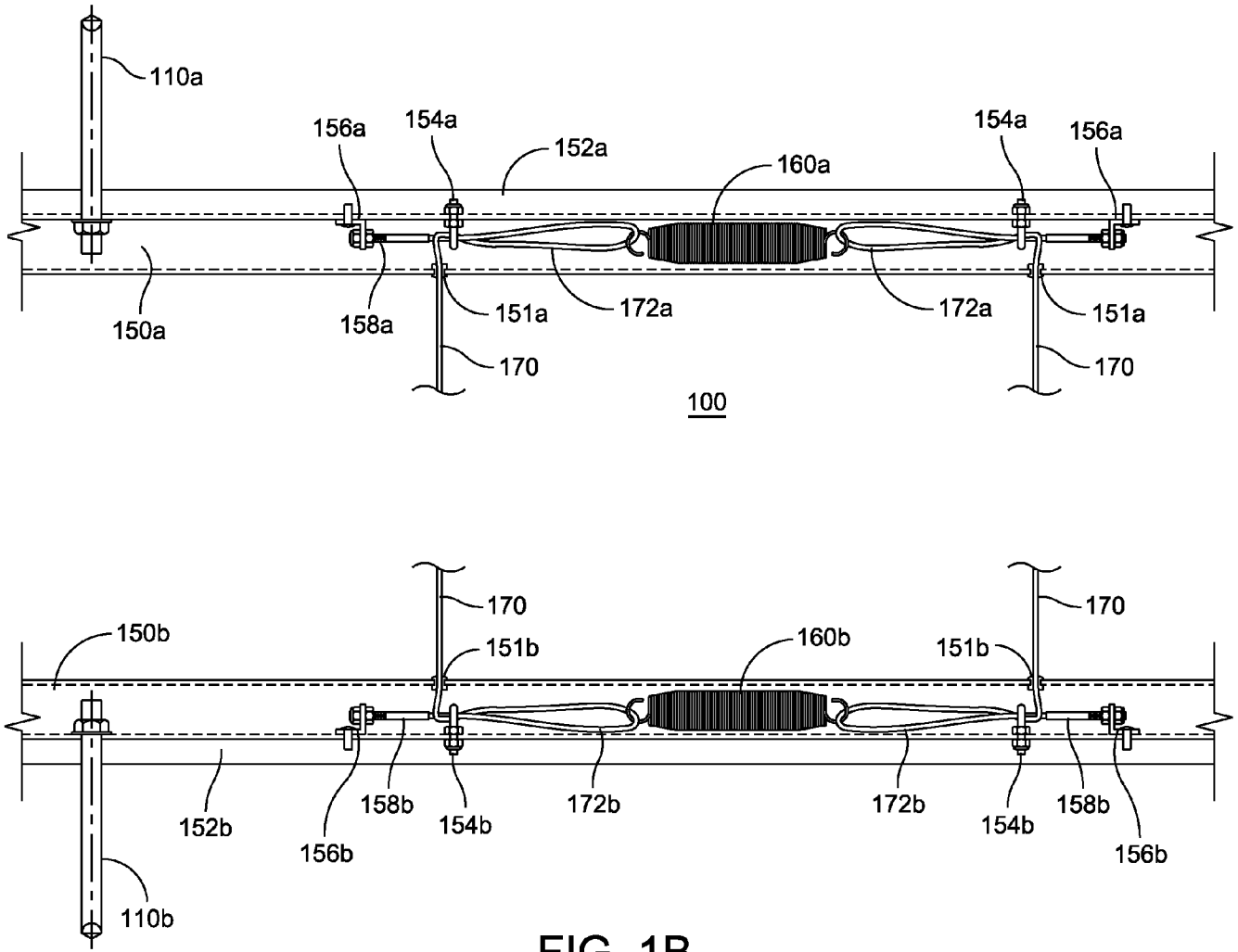
FIG. 1B is a front view of components of the blast retention system shown in FIG. 1A.

FIG. 1B is a partial frontal view showing the various components of the retention system 100 in more detail. Portions of the retention system 100 that are disposed at the header end of the window are designated with the letter "a" and portions disposed at the footer end of the window are designated with the letter "b". It should be understood that the header and footer components of the retention system 100 are identical in the illustrated embodiment. The retention system 100 includes mounting bodies 152*a*, 152*b*, which can take the form of shallow U-shaped load bearing rails in the illustrated embodiment. The mounting bodies 152 are secured to the wall 10 with a plurality of spaced upper and lower anchor members 110*a*, 110*b*. In one embodiment, these anchor members 110 comprise a plurality of bolts (also known as studs) and mating nuts/washers disposed through holes in the load bearing mounting bodies 152 and driven into the wall of the structure. These anchor members 110 secure the blast retention system 100 firmly to the structure during a blast event, allowing the retention system to catch a projected window pane(s) and dissipate the force of the blast. In most cases, it is expected that the anchor will be a ½-⅝ inch diameter threaded stud, embedded 2-4 inches into predrilled holes in concrete and secured therein using a high strength epoxy, such as Hilti HIT HY 20 or 150 adhesive available from Hilti North America of Tulsa, Okla. When the anchors 110 and mounting bodies 152 are in place and the epoxy has hardened in accordance with the manufacturer's instructions, the installation of the remaining components of the retention system can continue. It should be understood that the adhesive is not a requirement if the anchors meet the load bearing requirements without such adhesive. An adhesive is typically used with brick, masonry or hollow concrete substrates. Any number of anchors can be used with solid concrete substrates as long as they meet the strength requirements of the design.

A plurality of retention cables 170 are laterally spaced from one another and extend between the mounting bodies 152*a*, 152*b*. Cables 170 are preferably high strength and highly flexible galvanized or stainless steel cables. The cables may additionally have a colored vinyl coating for aesthetic purposes. The retention cables 170 can extend through the blind slats 130, if the retention system 100 is integrated with a blind system. The retentions system 100 could be integrated with curtains or other treatments, or no treatments at all. The ends of retention cables 170 terminate at horizontally oriented cable terminations 158*a*, 158*b* described in more detail below. These cable terminations 158*a*, 158*b* are connected to the mounting bodies 152*a*, 152*b* by L-shaped brackets 156*a*, 158*b* mounted on the major surface 153 of the mounting bodies 152, such as by high strength rivet connections. In embodiments, each leg of the L-shaped bracket is about 0.75" in length. At least one energy dampening device, such as a tension spring 160*a*, 160*b*, connects an adjacent pair of spaced retention cables 170. In the illustrated embodiment, a pair of tension springs 160*a*, 160*b* is provided to connect a pair of adjacent cables 170, one spring each at the header and footer. Each cable 170 includes a looped portion 170 for connecting the cable 170 to a tension spring 160. Restraint guides depend from the mounting rails 152 and are spaced inward of the brackets 156. In one embodiment, these restraint guides take the form of U-bolts, which provide a strong connection to the mounting rails 152 at two points and afford a desirable low profile. The U-bolts 154 are located just inward of the pass through-holes in the covers 150 for the cables 170. These pass-through holes in covers 150 can include grommets 151 of hard vinyl or brass to reduce friction during deployment of cables 170. U-bolts 154 are secured to the mounting rail surface 153 using, for example, four nuts and two lock washers on the top and bottom of the mounting rail. The restraint guides serve to crimp the cable 170 for forming looped portions 172, with the closed end of the loop portion 172 on the tension-spring side of the restraint guide 154 and the open end of the loop portion 172 on the bracket-side of the restraint guide 154. The restraint guides 154 also facilitates the transition in the orientation of cable 170 from its horizontal orientation at brackets 156*a*, 156*b* to its vertical orientation across window pane 24 and maintain the illustrated horizontal orientation of a portion of the cables 170 when the cables deploy under force of an impact. In embodiments, the U-bolts 154 and have a loop height of about 1.25 inches.

While the restraint guides 154 are shown as a round U-bolts, other restraint guides are appropriate as long as they provide a low profile and secure connection to the mounting rail 152. In embodiments, the restraint guides can be a round, square or slant U-bolts, or V-bolts, which have two connection points to the mounting rail 152. Restraint guides with single point connections may also be appropriate in various embodiments, such as round or square J-bolts, eye bolts or hook bolts. A pulley, such as an upright cast pulley, is an example of another possible restraint guide.

The cables 170 and tension springs 160 cooperate to form a deployable catch system that receives a window pane 24 that has been blown from its framework and dissipates the force of the impact of the reinforced glass pane 24 and the blast by expanding with the blast for a set amount and by allowing the blast to vent around, over and under the detached window pane 24 and blind system (if present).

The tension springs 160 keep the retention cables 170 in tension so that they stay straight, in a visually appealing orientation. The springs 160 also allow the cables to deploy into the structure, which allows venting of the blast pressure while catching the detached window pane 24. Finally, the springs 160 smooth out the impulse blast, i.e., spread out in time the "yank" exerted by the cables on the anchors so lower duty cables and anchors can be used. If the retention system is integrated with a blind system the blind system and retention cables cooperate to form a netting for catching the detached window pane and dissipating the force of the impact.

Figure 1C:
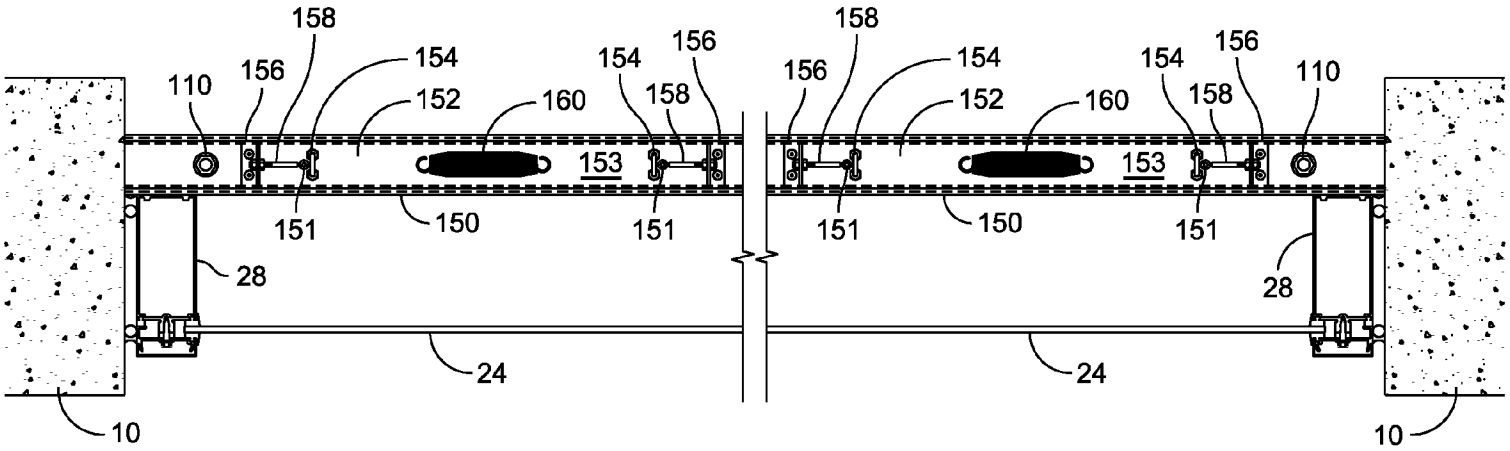
FIG. 1C is a top or bottom view of the blast retention system and window system shown in FIG. 1A.
Figure 1D:
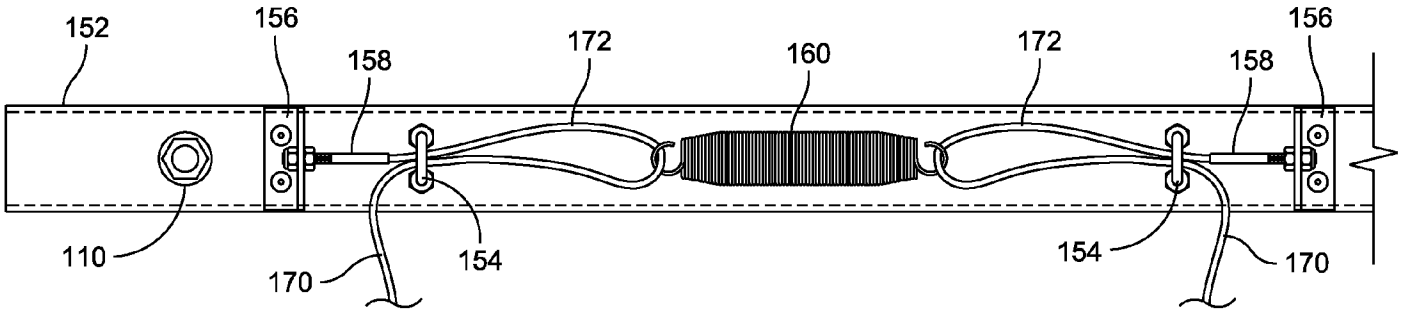
FIG. 1D is a top or bottom view of the components of the blast retention system shown in FIG. 1A.

FIG. 1C shows a cross-sectional view of the window system through cover member 150. For illustrative purposes, the retention cables 170 are not shown. As is customary, the window frame includes jamb members 28 disposed within the opening in wall 10. Together, jamb members 28, header 18 and footer 24 forms a frame for reinforced window pane 24. As can be seen from FIG. 1C, the illustrated embodiment uses two tension springs 160 at the header and two tension springs 160 at the footer for connecting four retention cables 170. FIG. 1D is a partial view of the retention system showing the cable 170.

Figure 2A:
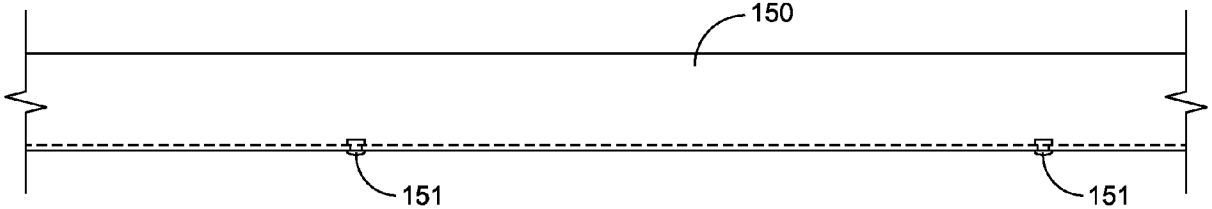
FIG. 2A is a side cross-sectional view of a cover element for the blast retention system shown in FIG. 1A.
Figure 2C:
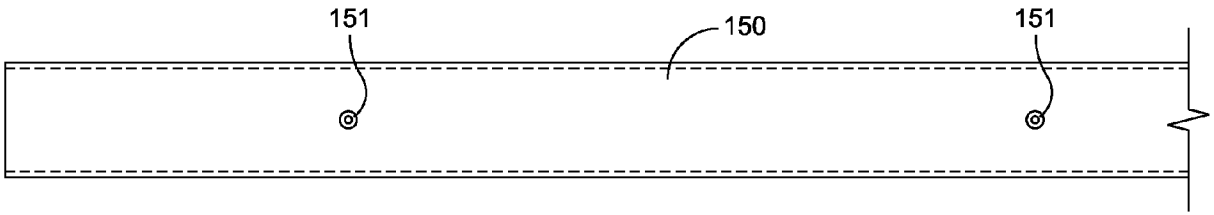
FIG. 2C is a top or bottom view of the cover element of FIG. 2A.
Figure 2D:
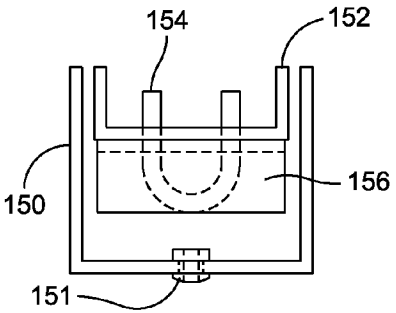
FIG. 2D is an end view illustrating the cover element of FIG. 2A fitted over a mounting body.
Figure 2B:
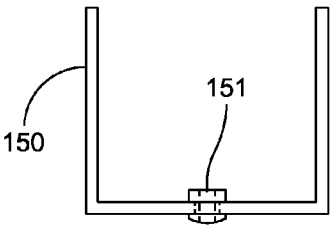
FIG. 2B is an end cross-sectional view of the cover element of FIG. 2A.

FIG. 2A-2C show the cover 150 in more detail. The cover 150 is designed to hide the internal components of the retention system, such as the tension springs 160 and the connection of the retentions cables 170 to the mounting rail 152 through brackets 156 and cable terminations 158. FIG. 2A is a side cross-sectional view of the cover 150. FIG. 2B is an end cross-sectional view of the cover 150. Finally, FIG. 2C is a top or bottom plan view, depending on whether the cover 150 is oriented at the header or footer of the window opening. As can be seen from the views, the cover 150 is a U-shaped member with pass through holes, slots or the like for the retention cables 170 and optional friction reduction grommets 151. FIG. 2D is a cross-sectional end view showing the cover 150 fitted over the mounting rail 152 to conceal the internal components of the retention system 100. End caps (not shown) can be used to cover the open ends of the cover 150 if the cover is not enclosed by the wall 10. The cover 150 can have a fitted over the mounting body 152 and fastened thereto (e.g., by screws, bolts, or other fastening means, etc.) to the mounting body 152. In embodiments, the cover 150 and mounting body 152 are each formed from a ⅛" thick aluminum sheet.

Figure 3:
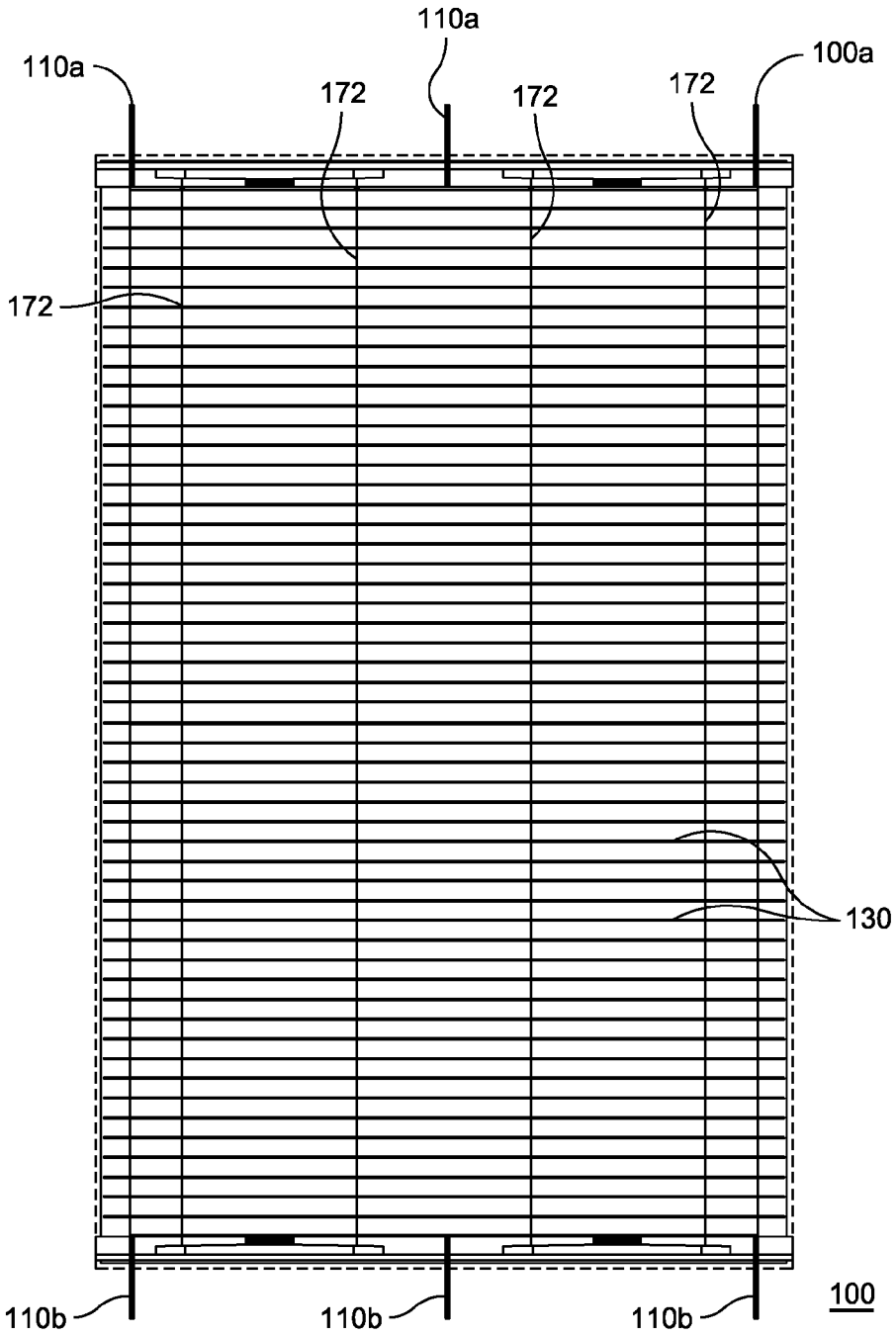
FIG. 3 is a front view of the retention system shown in FIG. 1A.

FIG. 3 shows the retention system 100 from the front view, with the covers 150 illustrated in phantom. In the illustrated embodiment, the retention system 100 employs four parallel, spaced retention cables 170 and six anchors 110. The retention cables 170 extend through the parallel blinds slats 130 of blind system in the manner shown and described in Gazaway et al. The blind system can be a conventional blind system, such as the illustrated horizontal blind system and include a conventional blind header, blind footer, and blind slats 130. Although not illustrated, the blind system may be provided with conventional actuating hardware, such as the cord tilt gears, ladder drums, and drum cradles for rotating the blind slats 130 and the cord and cord lock to raise and lower the blinds. The blind system can be interpreted with the blast retention system 100 and be mounted to the wall in the manner described in Gazaway et al.

In an exemplary embodiment, the tensioning springs 160 are "hobby horse" springs suspended between two adjacent cables 170. The spring characteristics (coil size, coil length, material and resistance factor) may be calculated or selected based on factors discussed below. This configuration is easy to assemble and allows the cables to adjust the load between each pair during a blast event, thereby equalizing the pressure on the glass sheet that impacts the retention system 100. The length and gauge of the cables 170, the spacing and number of cables 170, the spacing, type and number of anchors 110, the length and number of tensioning devices (e.g., springs 160), presence of and the number and spacing of blind slats 130, and the physical specifications of the springs 160 can be varied depending on the desired blast resistance (pull and sheer strength) and the size of the window or window opening. Other factors include the thickness of the glass, the thickness of any blast retention film on the glass, the expected blast load, the size of the anchors 110 and the strength of the building substrate to which the restraint system is attached.

As an example, a window opening that is 48 inches wide by 66 inches high that needs to meet a government Performance Condition 3 (also known as a "High Protection Level") in a medium blast loading of a peak pressure of 4 psi and an impulse of 28 psi-msec (commonly referred to as a GSA Level C blast load) may utilize a blast blind system that incorporates four ⅛-inch diameter vertical steel cables equally spaced 12 inches apart. A window opening 61 inches wide by 49 inches high that needs to meet a Performance Condition 3 in a much higher blast loading with a peak pressure of 10 psi and an impulse of 89 psi-msec (commonly referred to as a GSA Level D blast load) may utilize a blast blind system that incorporates six ⅛-inch diameter vertical steel cables equally spaced 11 inches apart The figures show the retention system 100 installed adjacent to the window frame supporting the window and spaced a distance from the interior surface of the wall 10. It should be understood that the spacing of the anchors 110 from the interior surface of the wall 10 is determined by the sheer strength requirements for the installation. In embodiments, the anchors 110 are spaced at least 3" from the interior surface of wall 10. Also, the retention system 100 can be installed directly on the window frame, with the anchors passing through the frame into the building substrate, i.e., the wall 10.

Figure 5A:
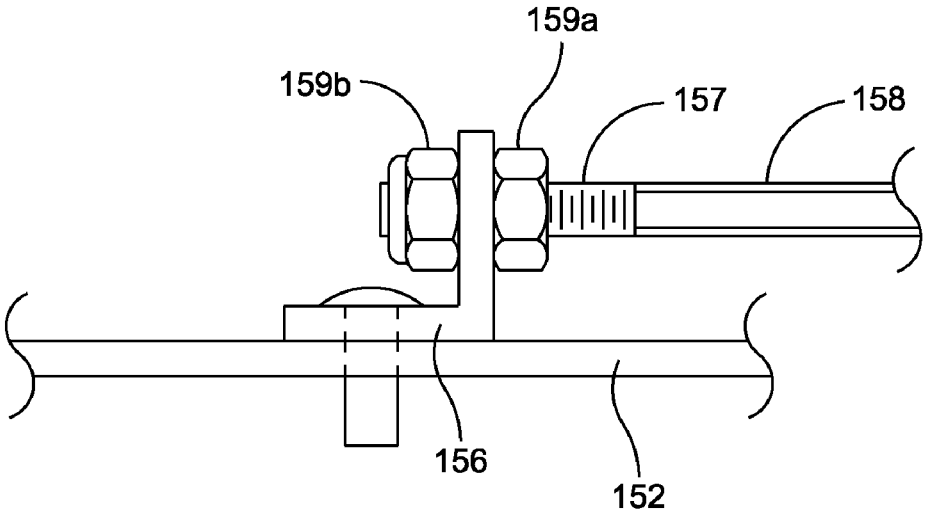
FIGS. 5A and 5B illustrate an embodiment of an adjustable cable termination connection in more detail.
Figure 5B:
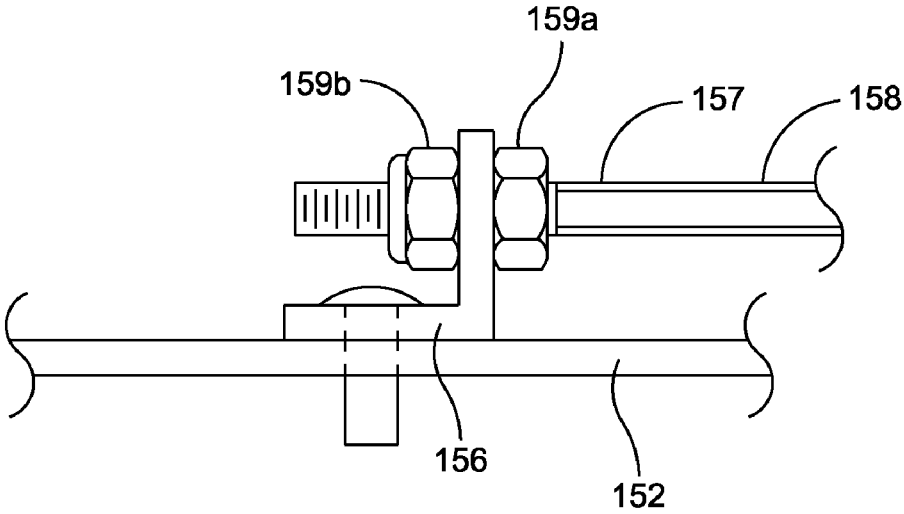

The cable length, spacing and tensioning device are preferably selected so that the cables are pulled taut in their quiescent (i.e., non-extended) state. The tensioning device allows the cables to travel inward with a blown glass sheet, allowing venting, dissipation, and distribution of the blast pressure, thereby preventing the anchors 110 from being pulled out of the building structure. At least some of the cable terminations 158 are adjustably connected to the bracket's 156 to allow for adjusting the slack in the retention cables 170 as desired to reach this preferred quiescent state, either during installation of the system 100 or thereafter to account for changes in the building as the building settles. The adjustable connection between the cable termination 158 and the bracket 156 is shown in more detail in FIGS. 5A and 5B. The end of the cable termination 158 has threads 157. Nuts 159 are provided on either side of the vertical arm of bracket 156. Nuts 159*a* and 159*b* can be backed away from or rotated towards the bracket 156 to a position on the threads 157 that obtains the desired slack (or lack thereof). Compare FIGS. 5A to 5B. Assuming about 1" of thread at each cable termination, the slack in a pair of adjacent cables can be adjusted by a total of about 4". Orienting this adjustable cable termination in the horizontal direction (rather than in a vertical orientation) allows for use of the full adjustment capabilities of the cable terminations 158 without using additional vertical profile space.

While tension cables 170 are illustrated in the various embodiments, in alternative embodiments, some or all of these tension cables can be replaced with other elements that could perform substantially the same deployment function, such as metal rods, steel wire, or high strength/high elongation synthetic or non-synthetic straps or cords. These restraint elements are sometimes collectively referred to herein as "pane engaging members." Also, although the adjacent cable sections are shown as individual cables, a single loop (or even serpentine path) of cable may be used to form a pair of adjacent cable sections (or even pairs of adjacent cables) in alternative embodiments.

Although the tensioning device or tensioner is shown as a tensioning spring 160, other elements may also be utilized. In one alternative embodiment, the tensioner may comprise a piston in a cylinder with a restricting viscous fluid or aperture with restricted dimension for escape of compressed fluid. A pair of coiled compression springs that operate against opposite walls of a housing may also be used or other element capable of elastic deformation. It may also be possible to use elements that are not reusable, such as energy wasting elements that are capable of plastic deformation or sequential shearing ring energy wasting devices, such as those described in U.S. Pat. Nos. 6,497,077 and 6,494,000 to Emek, the entirety of which are hereby incorporated by reference herein. Individual tensioners or energy wasting devices can be coupled along a length of single cable, such as described in the Emek patents, as opposed to between adjacent parallel lengths of restraining cable.

Figure 4A:
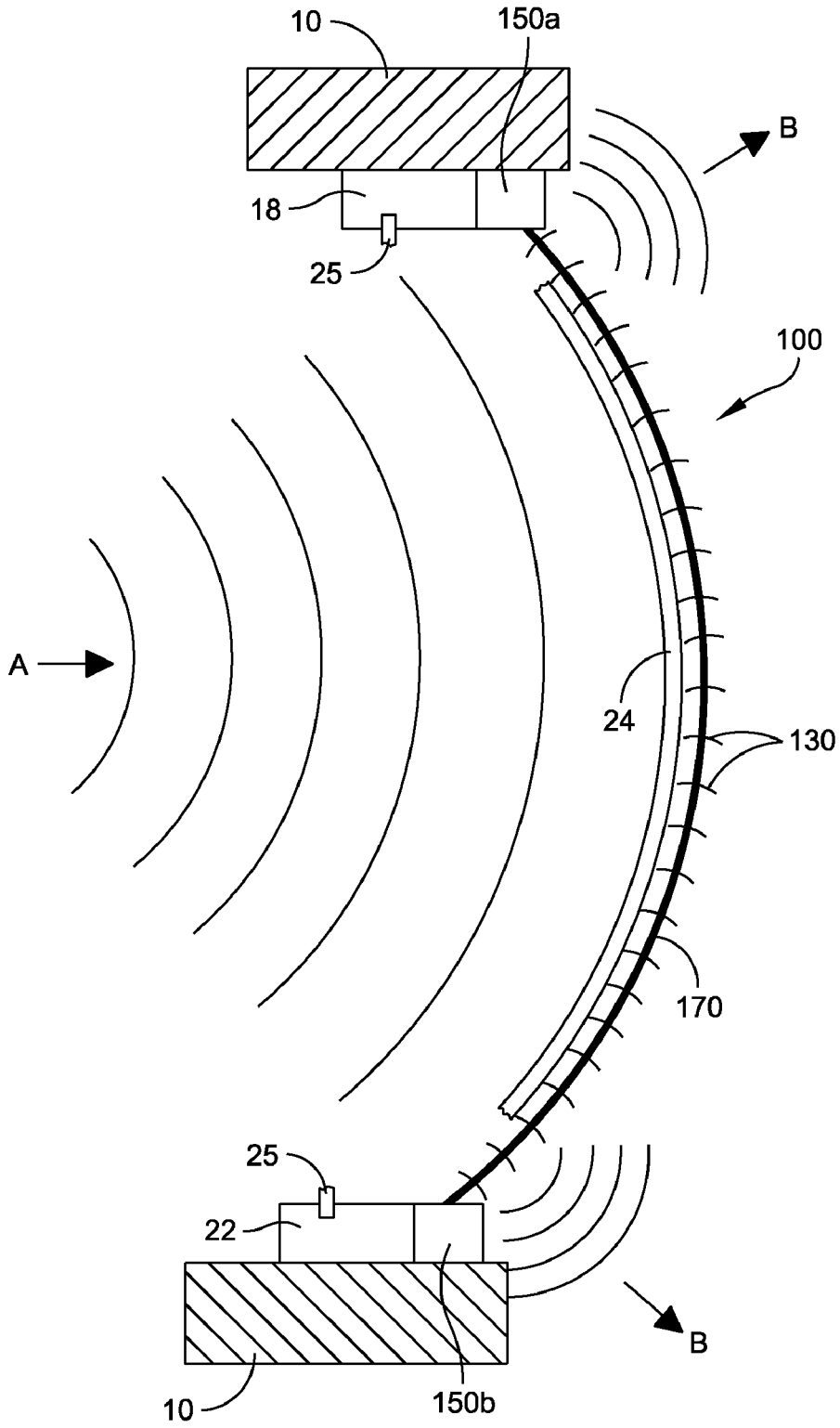
FIGS. 4A and 4B illustrate the operation of the retention system during a blast event.
Figure 4B:
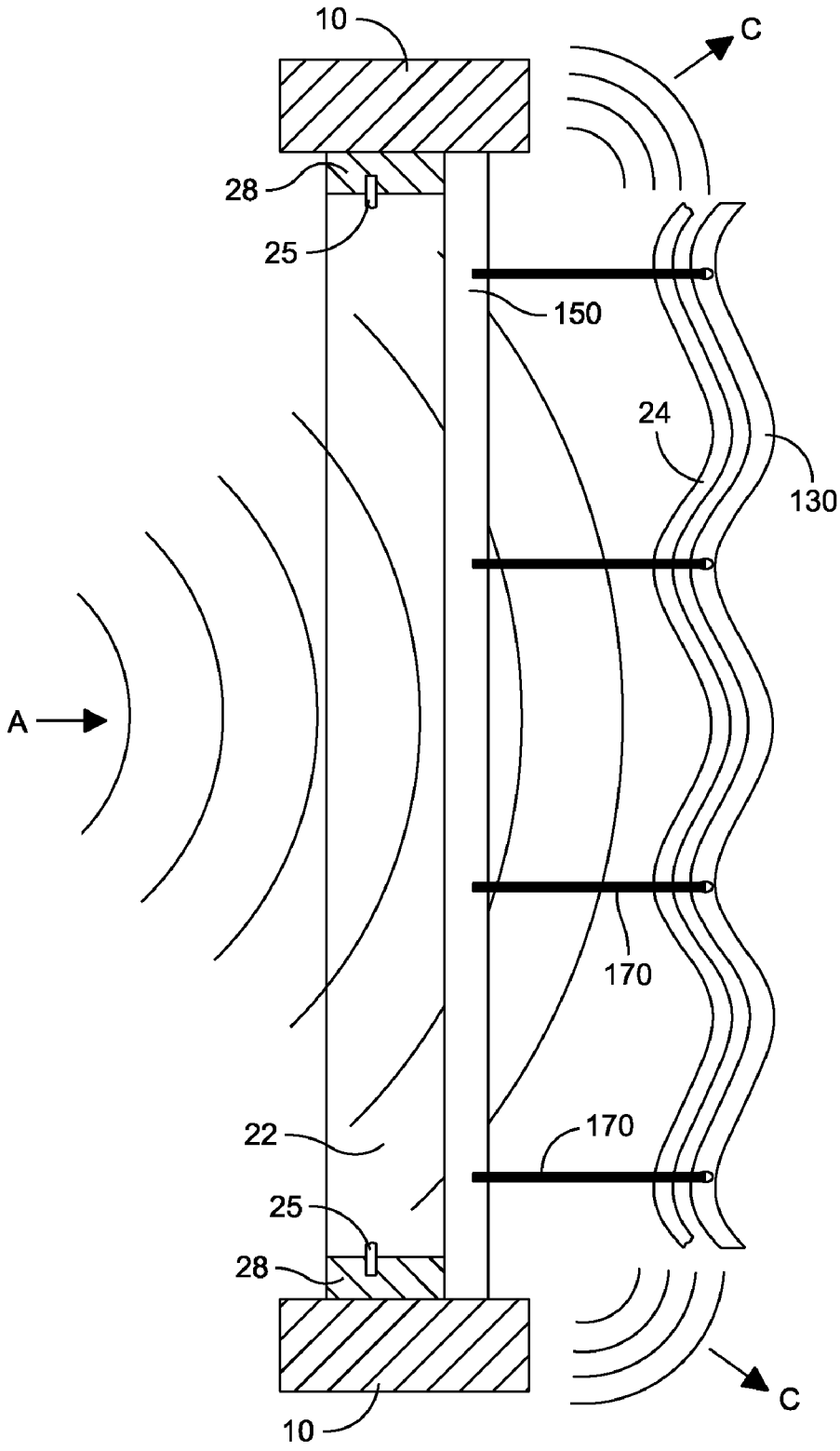

FIGS. 4A and 4B show the operation of the blast resistant system 100 during a blast event represented by blast pressure wave "A." FIG. 4A is a side view of an installed blast resistant system 100 during a blast event and FIG. 4B is a top view. In this illustrated embodiment, a window pane 24 located between window frame header 18 and window frame footer 22 (shown in simplified form) is reinforced with a fragment retention film to work in conjunction with the blast retention system. Blast pressure A from outside of a structure causes window pane 24 to break from its framework, leaving portions 25 in the framework. The panel 24 is blown into and caught by the blast retention system 100, where the cables 170 extend by means of the tensioning springs 160 housed within covers 150 and extra cable length. The cables 170 extend to catch the pane 24 and dissipate some of the force of the blast. The optional blind slats 130, through which the cables 170 pass, while being aesthetically pleasing, also serve to advantageously distribute the blast pressure across the surface of the blind system. The blind system conforms to the filmed (or otherwise reinforced) glass sheet 24 in an arc shape, distributing the resisting force evenly to the filmed glass, preventing the glass and film from tearing and transferring evenly the load to the anchors 110 in the structure. The blind slats 130 and cables 170 essentially form a coherent net for catching the blown reinforced glass sheet and evenly distributing the catch resistance across the sheet and into the anchor 110. Still further, the expansion of the cables and blinds, while accepting, dissipating and dispersing the force of the impact of the window pane 24, also creates space above and below the slats 130 through which the blast pressure can vent around the blind system (shown as blast pressure waves "B").

FIG. 4B is a top cross-sectional view of the installed blast resistant window retention system 100 operating during the blast event. FIG. 4B shows broken window pane 24 blown into horizontal blind slats 130 and extended cables 170. Broken window portions 25 remain in jamb members 28. In addition to allowing the blast pressure to disperse over and under the blind system (as shown by dispersing pressure waves B in FIG. 4A), the expansion of the cables 170 and the blind system also allows the blast pressure to escape around the side of the blind system, as shown by escaping pressure waves "C" in FIG. 4B.

In embodiments, extra blind slats 130 (e.g., approximately 10-14 inches of extra blind slats) are provided at the bottom of the blind system to accommodate cable deployment during a blast. This will allow approximately 5-7 inches of blast pressure venting space between the top header and vacated reinforced glass, as well as between the bottom footer and glass when the reinforced glass vacates the frame. The blinds preferably have enough extra slats to ensure that the blind coherent "net" is long enough to cover the entire detached window 24 upon full deployment of cables 170. The optimum spacing and/or strength of the restraining cables depends on blast engineering calculations. As the peak pressure and blast impulse increases, the size or number of cables will need to increase to meet the desired performance of the blind system. Likewise, as the window size increases, the size or number of anchors will also increase. The design components of the cable deployment length, spring length and the cable spacing are tightly interrelated and a change to one variable will require a change to the other two variables. For example, as the cable spacing decreases, the spring length must also decrease to keep the cable deployment length constant. The cables are preferably spaced evenly across the blinds, such as every 10-16 inches. In embodiments, the outermost cables are located approximately 3 inches from the ends of the blind header footer rails. The optimal spacing locations can be determined by a blast engineering analysis which considers the window size, the glass thickness, the glass type, the expected blast loading, the required blast hazard reduction level and other factors as necessary. In one embodiment, an even number of cables are spaced uniformly across the width of the blinds to simplify both the blast analysis and the blast blind system assembly process.

Returning to FIG. 1B, the use of a horizontally mounted cable termination 158 on a mounting bracket 156 allows for a reduction in the height of the header and footer components of the retention system 100 when compared to, for example, a ball swaged termination as disclosed in Gazaway et al. The height of the mounting rail need only be sufficient to account for the back side connection that secures the brackets 156 and restraint guides 154 to the mounting rail 152. In embodiments, the height of the mounting rails 152 is 0.75" or less, and the height of the cover 150 is 2.125" or less. Use of the restraint guides 154 helps to maintain the force of the cable deployment against the brackets 156 in a direction parallel to the major surface 153 of the mounting rails 152 rather than orthogonal thereto, which helps prevent bending of the brackets 156 from their L-shape. Maintaining the horizontal to vertical transition point in the cable 170 also maintains the proper spacing between adjacent cables 170, reducing the potential for the window pane to slip through the gap therebetween.

In embodiments, the footer rail of the blind system may be attached to the bottom cover 150*b* using, for example, self tapping screws. Fastening the footer rail 16 the bottom mounting assembly 150*b* keeps the blinds from being raised by the office occupant, which is important to allowing proper performance of the blinds during a blast event. The facility maintenance team can remove these screws and raise the blinds if access is required to the glass or frame members behind the blinds. Otherwise, in this embodiment, the blinds remain in their down position.

Figure 6:
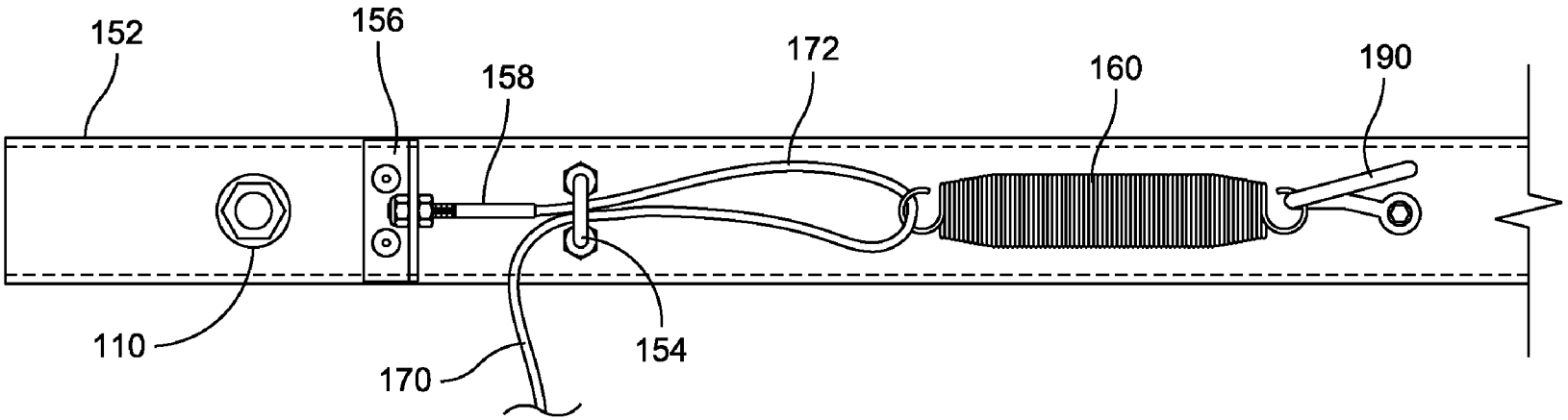
FIG. 6 illustrates and embodiment of an retention system where a single cable is connected to an end of a tension spring.

FIG. 6 shows an embodiment of the retention system where a tension spring 160 is connected to only one cable 170. This embodiment may be used alone or in connection with the embodiments illustrated in FIGS. 1A to 1D. For example, if it is determined that an odd number of cables are required, or a single cable is required (e.g., for a small or oddly shaped window), the set up of FIG. 6 can be used to provide for a tension cable connection between two opposite mounting rails. As can be seen from FIG. 6, the components of the system to the left of the tension spring 160 are identical to those discussed above. However, the opposite end of the tension spring 160 is connected to a hook 190 that is securely mounted to the mounting rail 152. It should be apparent that a similar rail configuration would be provided at the opposite mounting rail 152.

The embodiments of the blast retention system 100 described above and shown in the figures uses vertical retention cables 170 and optional horizontal blind slats 130. However, the concepts shown and described herein may also be adapted to use horizontal retention cables and an optional blind system having vertical blind louvers slats and conventional vertical blind header rail (which conceals components found in conventional vertical blind hardware, e.g., components for rotating and retracting the blinds). Components for retracting the blinds may be provided, such as to allow maintenance access to the window and may, optionally, be locked to prevent unauthorized use. Optionally, the blind system has no components for retracting the blinds, ensuring that the blinds cover the window in the event of a blast. A plurality of horizontal retention cables extend through the vertical blind slats, with adjacent cables coupled together with a tensioning device, such as the tensioning springs described above. The ends of the cables can be terminated at mounting rails, as described above. Covers or enclosures can be provided as described above, although they are vertically oriented and coupled to or adjacent to the jamb portions of a window frame. Anchors are also provided. The system would operate in the same manner as system 100 described above, and the same factors are considered in material selection, component sizing and spacing.

Although the figures illustrate embodiments where the panel engaging member are orthogonal to the blind slats (if provided), it is contemplated that in some embodiments, these panel engaging members may be oriented parallel to, and extend through, the blind slats, although such embodiments may require more panel engaging members to provide a substantially continuous net to catch the window pane as described above.

From the foregoing, an exemplary blast retention system is provided to prevent window glass from entering the interior of a structure during a blast event, thereby minimizing potential injury caused by glass and window component projectiles. The blast retention system may be integrated with a conventional window blind system, which provides for an aesthetic appearance, helping to hide the retention cables, and cooperates with the retention cables during a blast event to catch and retain a projected window pane. That is, the incorporation of a blind system with pane engaging members such as retention cables allows the blast resistant blind system to fully engage the blown glass panel during the blast event, transferring the tensile load to the structure, thereby stopping the glass, and evenly distributing the stopping force across the surface of the protection film, thereby preventing localized tearing and multiple projectiles. The system can be installed over an existing window system to catch blown glass while allowing effective venting of the overpressure of the blast.

Although the invention has been described in terms of exemplary embodiments, it is not limited thereto. Rather, the appended claims should be construed broadly to include other variants and embodiments of the invention that may be made by those skilled in the art without departing from the scope and range of equivalents of the invention.

What is claimed is:

1. A blast resistant window system installed over a reinforced window pane supported by a window framework mounted in an opening in a wall of a structure, the window pane having an inside surface facing an inside of the structure and an outside surface facing an outside of the structure, comprising:

a plurality of anchor members disposed in the wall of the structure;

first and second mounting bodies disposed at first and second opposite ends of the opening and secured to the structure with the anchor members, the first mounting body having a first pair of spaced brackets depending from a major surface of the first mounting body, the second mounting body having a second pair of spaced brackets depending from a major surface of the second mounting body;

a first energy dampening device disposed between the first pair of spaced brackets and a second energy dampening device disposed between the second pair of spaced brackets; and first and second restraining cables extending between the first and second mounting bodies across the inside surface of the window pane, the first and second restraining cables having first ends fixedly connected to the first pair of spaced brackets and second ends fixedly connected to the second pair of spaced brackets, wherein the cables are coupled together at the first opposite end of the opening by the first energy dampening device extending therebetween and at the second opposite end of the opening by the second energy dampening device extending therebetween.

2. The blast resistant window system of claim 1, wherein each cable has first and second looped portions connected to the first and second energy dampening devices, respectively.

3. The blast resistance window system of claim 2, wherein the first mounting body has a first pair of spaced restraint guides disposed between the first pair of spaced brackets and the first energy dampening device, and the second mounting body has a second pair of spaced restraint guides disposed between the second pair of spaced brackets and the second energy dampening device, wherein the cables extend through the first and second spaced restraint guides such that closed ends of the first looped portions, which are coupled to the first energy dampening device, are disposed on an energy dampening device-facing side of the first restraint guides and open ends of the first looped portions are disposed on a bracket-facing side of the first restraint guides, and such that closed ends of the second looped portions, which are coupled to the second energy dampening devices, are disposed on an energy dampening device-facing side of the second restraint guides and open ends of the first looped portions are disposed on a bracket-facing side of the second restraint guides.

4. The blast resistant window system of claim 3, wherein the spaced restraint guides comprise U-shaped restraint guides depending from the major surfaces of the mounting bodies.

5. The blast resistant window system of claim 3, wherein the energy dampening devices comprise tension springs having opposite ends thereof coupled attached to the looped portions of the restraining cables.

6. The blast resistant window system of claim 1, wherein at least one end of each cable is connected to an adjustable cable termination for permitting adjustment in an amount of slack in the cable.

7. The blast resistance window system of claim 1, wherein the restraining cables are steel restraint cable.

8. The blast resistant window system of claim 1, wherein the energy dampening device comprise tension springs having opposite ends thereof attached to the restraining cables.

9. The blast resistant blind system of claim 1, further comprising a pair of mounting enclosures coupled to the first and second mounting bodies for covering the energy dampening devices and ends of the restraining cables.

10. The blast resistant system of claim 1, wherein the mounting bodies comprise U-shaped rails having the major surfaces to which the brackets are attached.

11. The blast resistant system of claim 10, wherein the brackets are L-brackets.

12. The blast resistant system of claim 1, further comprising a blind system comprising a plurality of parallel blind slats, wherein the restraining cables are oriented orthogonal to the blind slats and extend through at least some of the blind slats, wherein during a blast event in which the window pane is blown towards the inside of the structure the blind system and pane engaging members cooperate to catch the window pane and distribute a restraining force across the window pane.

13. The blast resistant system of claim 1, further comprising:

a third restraining cable extending between the first and second mounting bodies across the inside surface of the window pane, the third restraining cable having ends thereof connected to the first and second mounting bodies by first and second respective brackets, and third and fourth energy dampening devices disposed at the first and second mounting rails, respectively, a first end of each of the third and fourth energy dampening devices being connected to the third restraining cable and a second end of each of the third and fourth energy dampening devices being coupled to one of the respective first and second mounting rails, wherein the third restraining cable includes a first portion at each end thereof extending horizontally from the first and second brackets, respectively, parallel to a major surface of first and second mounting rails towards the third and fourth energy dampening devices, respectively, a second portion including a cable loop portion connected at a closed loop end thereof to the first ends of the third and fourth energy dampening devices, respectively, and a third portion extending generally orthogonal to the first portions between the first and second mounting rails.

14. A window pane retention system for installation over a window pane to retain the window pane when projected towards the inside of a structure by a blast event, comprising:

a plurality of anchor members for anchoring the window pane retention system to a wall of the structure;

first and second mounting rails spaced from one another, the first and second mounting rails being secured to the anchor members, the first mounting rail having a first pair of spaced brackets depending therefrom;

a first energy dampening device disposed between the first pair of spaced brackets; and first and second sections of restraining cable extending between the first and second mounting rails, the first and second sections of restraining cable having first ends connected to the first pair of spaced brackets of the first mounting rail, wherein the sections of restraining cable each include a first portion extending horizontally from a respective bracket parallel to a major surface of first mounting rail towards the first energy dampening device, a second portion forming a cable loop portion connected at a closed loop end thereof to a respective end of the first energy dampening device, and a third portion extending generally orthogonal to the first portion, the third portion extending between the first and second mounting rails.

15. The window pane retention system of claim 14, wherein the first and second cable sections comprise first and second retention cables, the window pane retention system further comprising a second energy dampening device connected between the first and second return cable at the second mounting rail.

16. The window pane retention system of claim 14 wherein the first mounting rail has a first pair of spaced restraint guides disposed between the first pair of spaced brackets and the first energy dampening device, wherein the respective closed loop end of the cable loop portion is disposed on an energy dampening device-facing side of the first restraint guides and the third portion is disposed on a bracket-facing side of the first restraint guides.

17. The window pane retention system of claim 16 wherein the spaced restraint guides comprise looped restraint guides depending from the major surface of the first mounting rail.

18. The blast resistant window system of claim 14, wherein the first energy dampening device comprises a tension spring having opposite ends thereof coupled to the first and second sections of restraint cable.

19. The blast resistant window system of claim 14, wherein the first ends of the first and second sections of restraint cable are connected to the first brackets with a pair adjustable cable terminations for permitting adjustment in an amount of slack in the cable sections.

20. A blast resistant window system installed over a reinforced window pane supported by a window framework mounted in an opening in a wall of a structure, the window pane having an inside surface facing an inside of the structure and an outside surface facing an outside of the structure, comprising:

a plurality of anchor members disposed in the wall of the structure;

first and second mounting rails disposed at first and second opposite ends of the opening and secured to the structure with the anchor members, a first tension spring disposed at the first mounting rail and second tension spring disposed at the second mounting rail; and first and second restraining cables each extending between the first and second mounting rails and including a major portion extending across the inside surface of the window pane, the first and second cables having first ends terminating at a first pair of cable terminations and second ends terminating at a second pair of cable terminations, wherein the cable terminations are fixed to the first and second mounting rails in a horizontal configuration such that the cables have minor portions extend from their cable terminations generally parallel to the major surfaces of the mounting rails toward the first and second tension springs to form looped portions connected to respective ends of the first and second tension springs, the looped portion of each cable connecting the major portion of that cable to the minor portion; and a blind system comprising a plurality of parallel blind slats, wherein the major portion of the restraining cables are oriented orthogonal to the blind slats and extend through at least some of the blind slats to form an integrated netting for catching a window pane blown towards the inside of the structure during a blast event, the cables deploying upon impact to at least partially dissipate a force of impact with the netting by the window pane.

21. The blast resistant window system of claim 20, wherein at least one of the cable terminations connected to each cable is an adjustable cable termination for permitting adjustment in an amount of slack in the cable.

* * * * *